United States Patent [19]

Francis

[11] Patent Number: 4,899,454

[45] Date of Patent: Feb. 13, 1990

[54] PERSPECTIVE DRAWING MACHINE

[75] Inventor: John G. R. Francis, Manning, S.C.

[73] Assignee: Trig.o.metrics Corporation, Manning, S.C.

[21] Appl. No.: 194,246

[22] Filed: May 16, 1988

[51] Int. Cl.[4] ..... B43L 13/14

[52] U.S. Cl. ..... 33/432; 33/1 K; 33/433; 33/434

[58] Field of Search ..... 33/432, 433, 434, 430, 33/1 K

[56] References Cited

U.S. PATENT DOCUMENTS

| | | | |
|---|---|---|---|
| 2,380,073 | 7/1945 | Robinson | 33/432 |
| 2,667,694 | 2/1954 | McQuaid, Sr. et al. | 33/432 |
| 2,669,025 | 2/1954 | Hysing | 33/432 |
| 2,901,832 | 9/1959 | Hulen | 33/434 |
| 3,343,267 | 9/1967 | Wolf | 33/434 |
| 3,719,995 | 3/1973 | Sauvageau | 33/433 |
| 4,453,318 | 6/1984 | Hayes | 33/432 |

FOREIGN PATENT DOCUMENTS

| | | | |
|---|---|---|---|
| 456009 | 3/1950 | Italy | 33/432 |
| 755618 | 9/1980 | U.S.S.R. | 33/432 |

*Primary Examiner*—William A. Cuchlinski, Jr.
*Assistant Examiner*—Diego F. Gutierrez
*Attorney, Agent, or Firm*—Sughrue, Mion, Zinn, MacPeak & Seas

[57] ABSTRACT

A drafting table includes vertical and horizontal straight edged supports together with drive mechanisms for moving the vertical straight edge such that it will always point to a viewing point and for moving the horizontal straight edges in plural different modes. In a first mode, the two horizontal straight edges are moved such that their edges always point to respective vanishing points. In a second mode the horizontal straight edges are moved such that one continues to point to a vanishing point while the other maintains a fixed angle with respect to horizontal, and so that their edges always intersect at a point along the line of view. The drive mechanisms for the horizontal straight edge supports can be disabled, reversed or their drive ratios changed in accordance with the particular drawing being made.

23 Claims, 5 Drawing Sheets

PERSPECTIVE DRAWING MACHINE

BACKGROUND OF THE INVENTION

This invention is directed to the field of perspective drawings. Furthermore, it is directed to perspective drawing machines with variable vanishing points whose straight edges are moveable in a calibrated fashion.

The prior art in the general field of perspective drawings is quite extensive as represented by over 100 patents ranging from relatively simple devices such as the Drafting Table of G. Ring, U.S. Pat. No. 795,065 dated July 18, 1905, to the Perspective Drafting Machine of Frank R. Wurtz, U.S. Pat. No. 4,360,955 dated Nov. 30, 1982.

The extensiveness of the prior art establishes the long standing need of and search for a device which greatly simplifies and expedites the process of making true perspective drawings.

SUMMARY OF THE INVENTION

It is therefore an object of the present invention to provide a perspective drawing machine which is (1) easier to use, (2) more versatile in that it can be used to make standard, perspective, and parallel perspective drawings, and (3) eliminates the need for many accessories such as scaled rulers while maintaining a relatively simple and inexpensive construction.

In its preferred embodiment, this machine utilizes two gear reduced drive shafts, one of which drives a single screw shaft located across the top of the table for precision calibrated positioning of the vertical straight edge and the other of which drives three independent screw shafts located along the center and both sides of the table, the center shaft of which cooperates simultaneously with each of the two side shafts for the precision calibrated positioning of the left and right "horizontal" straight edges.

The side screw shafts operate through individual plug-in gear reduction modules which can be preselected to cause their respective straight edges to move in either true horizontal fashion or in such a manner that each straight edge is always pointing to respectively selected left and right vanishing points.

For simplicity of discussion, the drawings depict a single set of gear selections for the drawing of an object which is turned counter clockwise 30 degrees away from the observer (see angle $\theta$ in FIG. 1). Likewise, the descriptions are limited to 10 specific corresponding locations of the right, left, and station vanishing points (VR, VL and S respectively in FIG. 1). However in reading the detailed description herein, it will be obvious that this invention will work equally well at all feasible viewing angles and distances.

The types, sizes, configurations, etc. of the gears and gear mechanisms have been selected to simplify the description of the basic principals of the invention. Consequently, bearings, retaining pins, clips, etc. are not shown in the drawings.

DETAILED DESCRIPTION OF THE PREFERRED EMBODIMENTS

Figure 1:
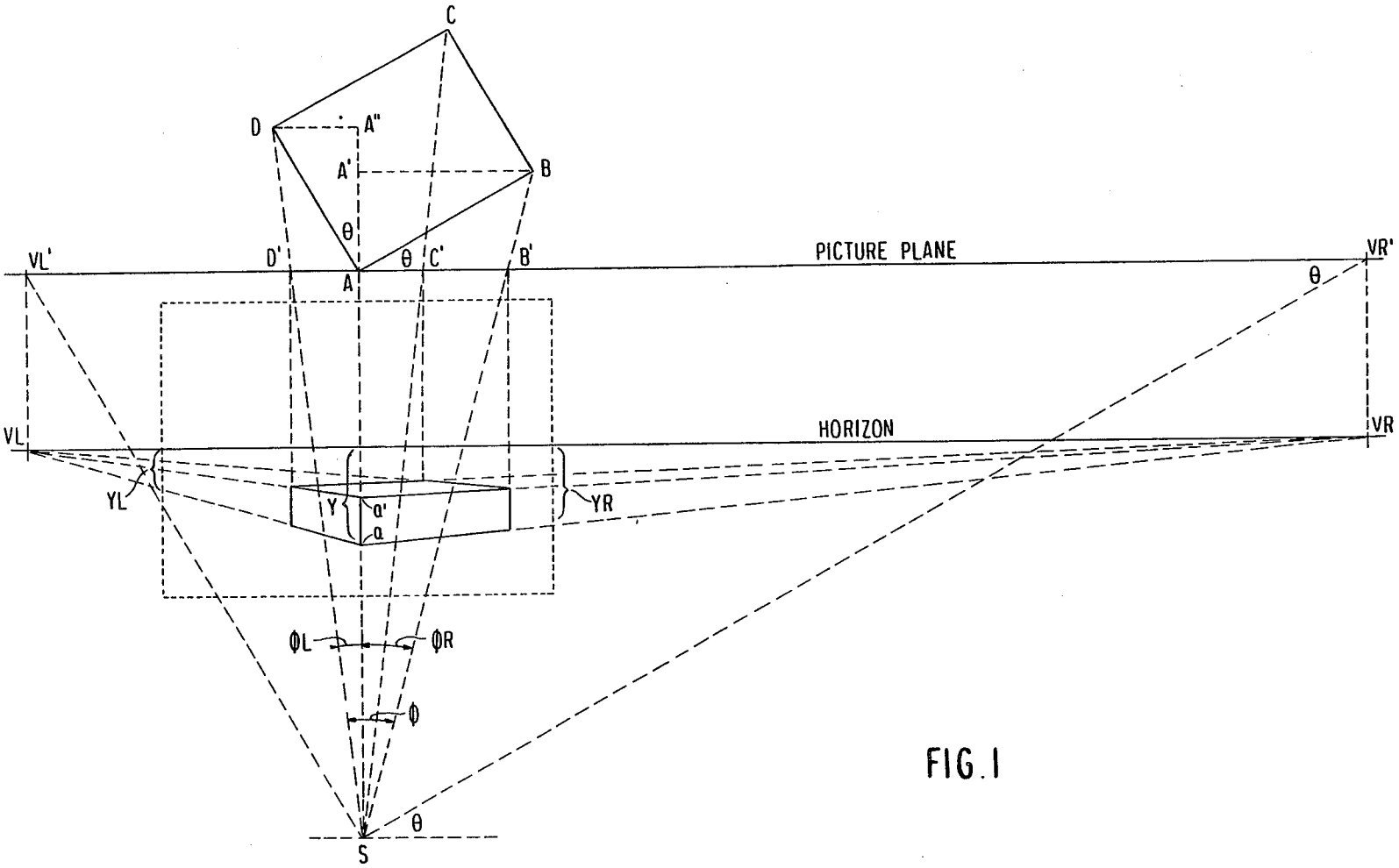
FIG. 1 is a sketch of a typical perspective layout and is included to facilitate a brief discussion of the principals of perspective drawings as they relate to this invention.

With reference to FIG. 1, the locations of the Right and Left Vanishing Points (VR and VL), are determined by the size of the object to be drawn and by the angle it is rotated away from the Picture Plane. The object in this case is a box 2 feet long (AB), by 1.7 feet wide (AD), by .5 feet high (aa'), as observed from an eye level (Horizon) 1 foot above the base of the box.

For a pleasant undistorted perspective, textbooks recommend a Viewing Angle ($\phi$) of approximately 20 degrees. Ideally, the would determine how wide (D'B') he wanted his perspective to be and would then locate the Station Point (S) at such distance (SA) that the Viewing Angle ($\phi$) is approximately 20 degrees.

The coordinates of the Vanishing Points VR and VL would then be located by drawing lines through S and parallel to the sides (AB and AD) of the object to be drawn until they intersect the Picture Plane at VR and VL, respectively, and then projecting them vertically downwards until they intersect the Horizon.

The corner of the box (A) has been located at the intersection of the Line of Vision (SA) with the Picture Plane, the side AB has been rotated 30 degrees ($\theta$), and the distance from the Line of Vision to the Right Vanishing Point (VR) has been preselected to be 10 feet.

The following values are therefore given: AB=2.0 ft., AD=1.7 ft., AVR=VR=10.0 ft., and $\theta=30°$.

To locate the Station Point (S), one computes as follows:

$\text{Tan}\ \theta = SA/VR$ $SA = VR \times \text{Tan}30° = 10 \times .57735 = 5.77$ ft.

To locate the Left Vanishing Point (VL), one computes as follows:

$\text{Tan}\ \theta = VL/SA$ $VL = SA \times \text{Tan}30° = 5.7735 \times .57735 = 3.33$ ft.

To determine the lengths of the sides AB and AD as they appear in perspective (AB' and AD'), one can either project them to the Picture Plane by drawing lines from S to B and D, or they can be computed as follows:

$AA' = \text{Sin}30° \times AB = .5 \times 2 = 1.0$ ft.

$A'B = AA'/\text{Tan}30° = 1/.57735 = 1.73$ ft.

$A''D = \text{Sin}30° \times AD = .5 \times 1.7 = .85$ ft.

$AA'' = A''D/\text{Tan}30° = .85/.57735 = 1.47$ ft. Since:

$AB'/AS = A'B/(A'A + AS)$, then, $AB' = A'B \times AS/(A'A + AS) = 1.73 \times 5.77/(1 + 5.77) = 1.47$ ft. and:

$AD' = A''D \times AS/(A'A + AS) = .85 \times 5.77/(1.47 + 5.77) = .67$ ft.

To determine the Viewing Angle ($\phi$), one can compute as follows:

$\text{Tan}\phi R = A'B/A'S = AB'/SA = 1.476/5.77 = .2557$ $\phi R = 14.34°$ $\text{Tan}\phi L = A''D/A''S = AD'/SA = .6774/5.77 = .1173$ $\phi L = 6.69°$ $\phi = \phi R + \phi L = 21.03°$ As will be seen in later discussions, the ratio of the vertical distances (Y) from the Horizon of points along the Center of Vision to the vertical distances (YR and YL) from the Horizon of points along the sides of the Drawing Table (represented by the dotted lines in FIG. 1) are critical to my design. In the example given in the drawings, my Drafting Table is 4 feet wide with its vertical center line also representing the Center of Vision. The top and bottom horizontal edges and left and right vertical side edges of the drafting table surfaces are shown in dotted outline in FIG. 1.

From the Law of Inscribed Triangles we know that:

$Y/VR=YR/(VR-2)$ $YR=Y\times(VR-2)/VR=Y\times 8/10=.8Y$

Or in other words, given a table as described and a right vanishing point located 10 ft. away from its center, vertical distances measured from the Horizon at the right side of the table will always be 80% of what they are at the center.

Likewise:

$Y/VL=YL/(VL-2)$ $YR=Yx(VL-2)/VL=Yx(3.33-2)/3.33=.4y$ or 40% of Y.

Figure 2C:
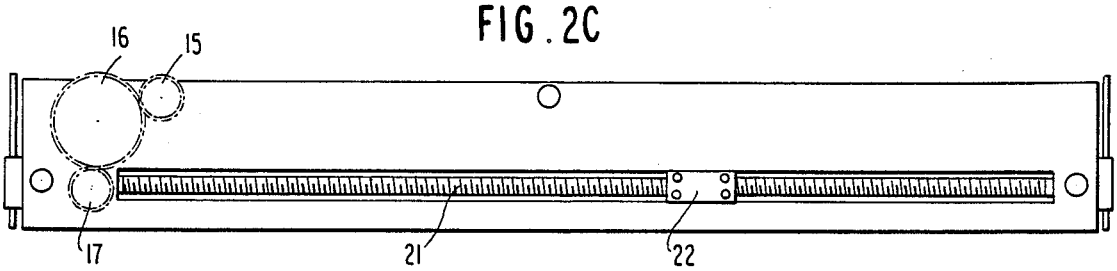
FIGS. 2A, 2B, and 2C are front, top and reversed rear views, respectively of the Table. The drawing surface, table bottom, straight edges, gear covers, etc. have been removed so that the inner mechanisms can be shown more clearly. For the same reason, bearings, gear covers, retaining pins, clips, etc. are not depicted.

With the above in mind and with reference to FIGS. 2A, 2B, and 2C, the various gears and mechanisms which control the movements of the three straight edge devices will now be described.

The Vertical Drive Gear 10 has 100 teeth, is affixed to the front of the table via a Shaft 11, bearings and clips (not shown) and can be rotated by means of a Crank 12 or a motor (not shown).

Power is transferred to the Vertical Screw Shaft 21 via Pinion Gear 13, Vertical Drive Shaft 14, Spur Gears 15, 16 and 17. Shaft 18 and Bevel Gears 19 and 20. The Vertical Drive Shaft 14 and the Center Horizontal Screw Shaft 124 are located under the bottom (not shown) of the table to facilitate the mounting of variable intensity lights (not shown) below a translucent drawing surface (not shown).

Pinion Gear 13 has 20 teeth for a gear ratio of 5 to 1. Spur Gears 15 and 17 have the same number of teeth as is the case with Bevel Gears 19 and 20 which results in one revolution of Vertical Screw Shaft 21 for each revolution of Pinion Gear 13. The Vertical Screw Shaft 21 has five threads per inch, so that each revolution of Vertical Drive Gear 10 will result in a one inch movement of Vertical Straight Edge Positioner 22. All of the gears are such that a clockwise rotation of the Vertical Drive Gear 10 will move the Vertical Positioner 22 to the right and vice versa.

Since engineering scales are based on one inch equaling so many feet, the system as described lends itself quite well to calibrated movement as will be discussed later.

The Horizontal Drive Gear 110 similarly has 100 teeth, is affixed to the front of the table via a Shaft 111 and can be turned via a Crank 112 or a motor (not shown).

Power is transferred to the Horizontal Drive Shaft 117 via Pinion Gear 113, Shaft 114 and Bevel Gears 115 and 116. The Pinion Gear 113 has 20 teeth for a gear ratio of five to one, and the Bevel Gears 115 and 116 have the same number of teeth which results in five revolutions of the Horizontal Drive Shaft 117 for each revolution of Drive Gear 110.

Power is transferred to the Center Horizontal Screw Shaft 124, which has five threads per inch, via Bevel Gears 118 and 119, Shaft 120, and Spur Gears 121, 122 and 123. Both Bevel Gears 118 and 119 have the same number of teeth, as is the case with Spur Gears 121 and 123. Consequently. Center Screw Shaft 124 rotates at the same rate as the Horizontal Drive Shaft 117, resulting in a one inch movement of Center Positioner 125 for each revolution of Drive Gear 110. All of the gears are such that clockwise rotation of the drive gear results in the Center Positioner 125 moving towards the front of the table and vice versa. Center Positioner 125 may thus be considered a first positioning means with the shaft 124 and its source of driving power being considered a first position control means for controlling the vertical position of the first positioning means 125.

Power transfers to the Right and Left Horizontal Positioners 225 via the two Bevel Gears 218 (located at either end of Drive Shaft 117), Three Position Reversing Bevel Gears 219, Spline Shafts 220, Reducing Gears 221, 222 and 223, and respective Right and Left Horizontal Screw Shafts 224 both of which have five threads per inch. Right and Left Horizontal Positioners 225 may thus be considered a second positioning means with the shafts 224 and their sources of driving power being considered a second position control means for controlling the vertical position of the second positioning means 225.

Figure 2B:
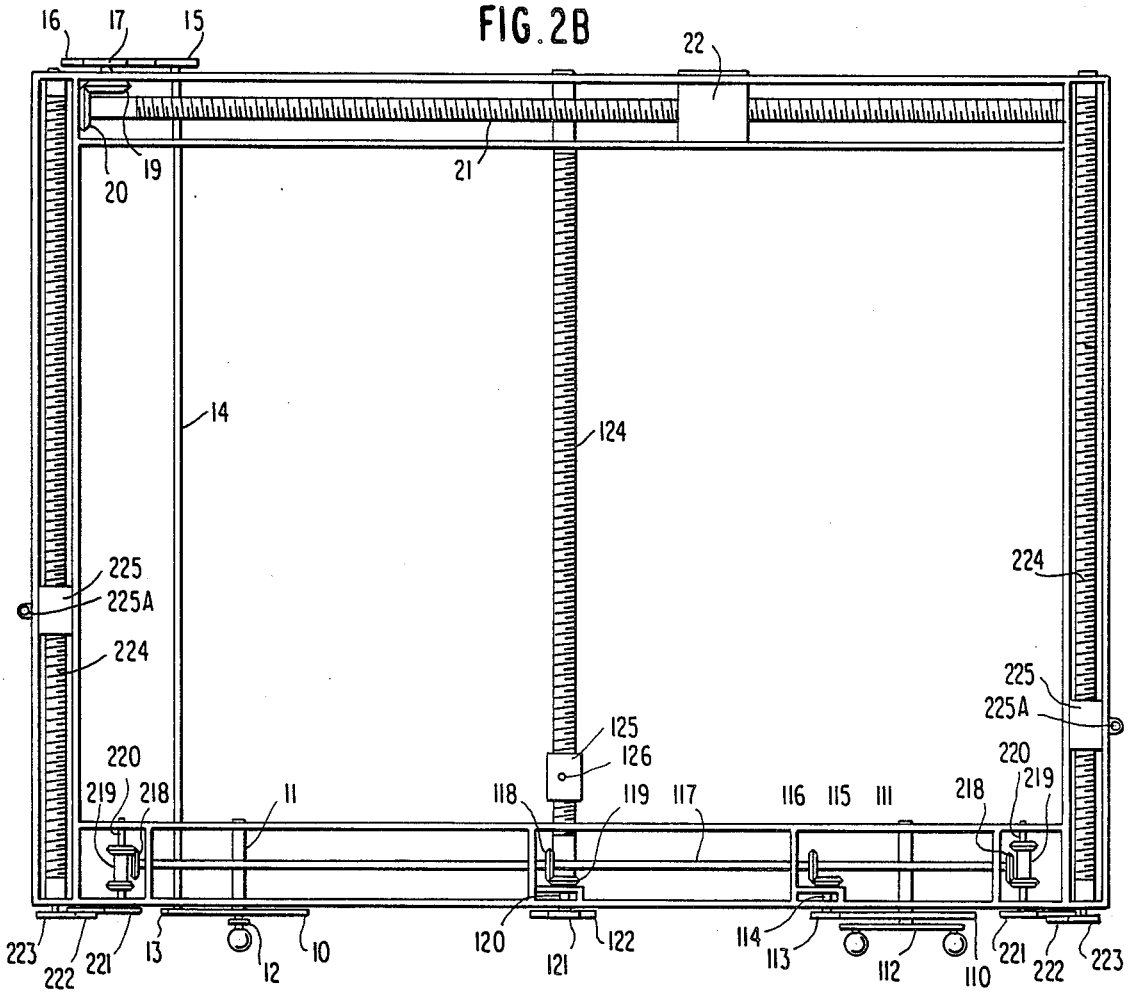
Figure 2A:
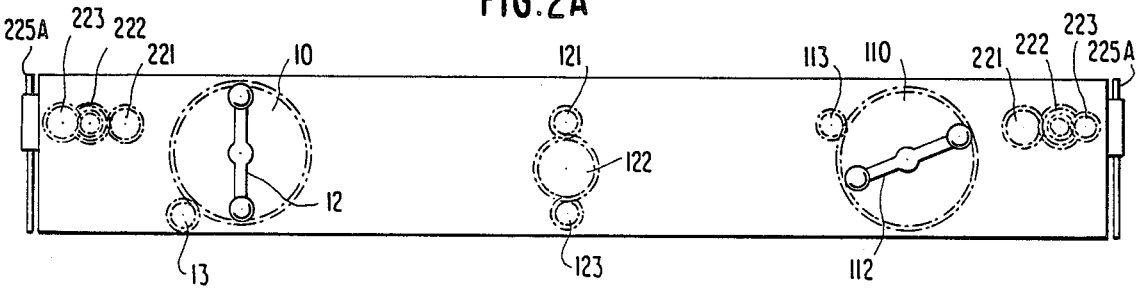

With the two Reversing Gears 219 in the respective positions as shown in FIG. 2B, their Positioners 225 move in the same direction as the Center Positioners 125. Each Reversing Gear 219 can slide on its Spline Shaft 220 in such a manner that it can be disengaged via a three position lever (not shown) located in the bottom of the table, or individually reversed to cause its positioner to move in a direction opposite to that of the center positioner.

Disengagement facilitates realignment of the side positioners with the center positioner at the beginning of any new table setup, or when a vanishing point is located exactly two feet from the vertical center line of the table.

Reversing the direction of either positioner is necessary when its respective vanishing point is located less than two feet from the vertical center line of the table.

Each set of the three Reducing Gears (221, 222 and 223) is actually enclosed in a plug-in module (not shown) to facilitate changing the right and left vanishing points to any desired location. Each set of three gears is selected to provide both the desired gear reduction, as well as a constant separation of the centers of the two outside gears, so that splines extending from them will conveniently engage with receptacles in the forward ends of the Spline Shafts 220 and the Screw Shafts 224.

The table that follows lists all of the pertinent values for 10 different viewing points of an object turned 30 degrees from the Picture Plane. W is the ideal width in feet of the actual perspective with a Viewing Angle of exactly 20 degrees. SP is the distance in feet of the station or viewing point from the picture plane, VL is the distance of the left vanishing point from the vertical line center of the table, GML is the number of teeth for each gear in the left gear module, VR is the distance from the right vanishing point to the vertical line center of the table, and GMR is the number of teeth for each gear in the right gear module.

The numbers in the GML and GMR columns are arranged to correspond to the positions of the gears in plan view as shown in FIG. 2B, e.g., in the first line of the table Reducing Gears 221 and 223 have 24 and 30 teeth, respectively, while the portion of Reducing Gear 222 meshing with Reducing Gear 221 has 24 teeth and the portion of Reducing Gear 222 meshing with Reducing Gear 223 has 12 teeth. In addition, the asterisks that appear in the GML and GMR columns indicate that the pertinent Reversing Gears 219 need to be put in their reverse positions and the zeros indicate that the pertinent reversing gear needs to be disengaged.

TABLE 1

| W | SP | VL | GML | VR | GMR |
|---|---|---|---|---|---|
| 2.04 | 5.7735 | 3.33 | 24-24 | 10.0 | 27-27 |
| | | | 30-12 | | 16-20 |
| 1.83 | 5.1962 | 3.00 | 25-25 | 9.0 | 29-29 |
| | | | 30-10 | | 14-18 |
| 1.63 | 4.6188 | 2.67 | 30-15 | 8.0 | 24-24 |
| | | | 30-15 | | 18-24 |
| 1.43 | 4.0415 | 2.33 | 30-15 | 7.0 | 27-27 |
| | | | 35-10 | | 15-21 |
| 1.22 | 3.4641 | 2.00 | 0 | 6.0 | 25-25 |
| | | | | | 16-24 |
| 1.02 | 2.8868 | 1.67 | *32-16 | 5.0 | 21-21 |
| | | | 30-12 | | 18-30 |
| .81 | 2.3094 | 1.33 | *24-24 4.0 | 24-24 | |
| | | | 28-14 | | 14-28 |
| .61 | 1.7321 | 1.00 | *25-25 | 3.0 | 25-25 |
| | | | 20-20 | | 10-30 |
| .41 | 1.1547 | .67 | *27-27 | 2.0 | 0 |
| | | | 12-24 | | |
| .20 | .5774 | .33 | *16-32 | 1.0 | 25-25 |
| | | | 12-30 | | *20-20 |

Figure 3:
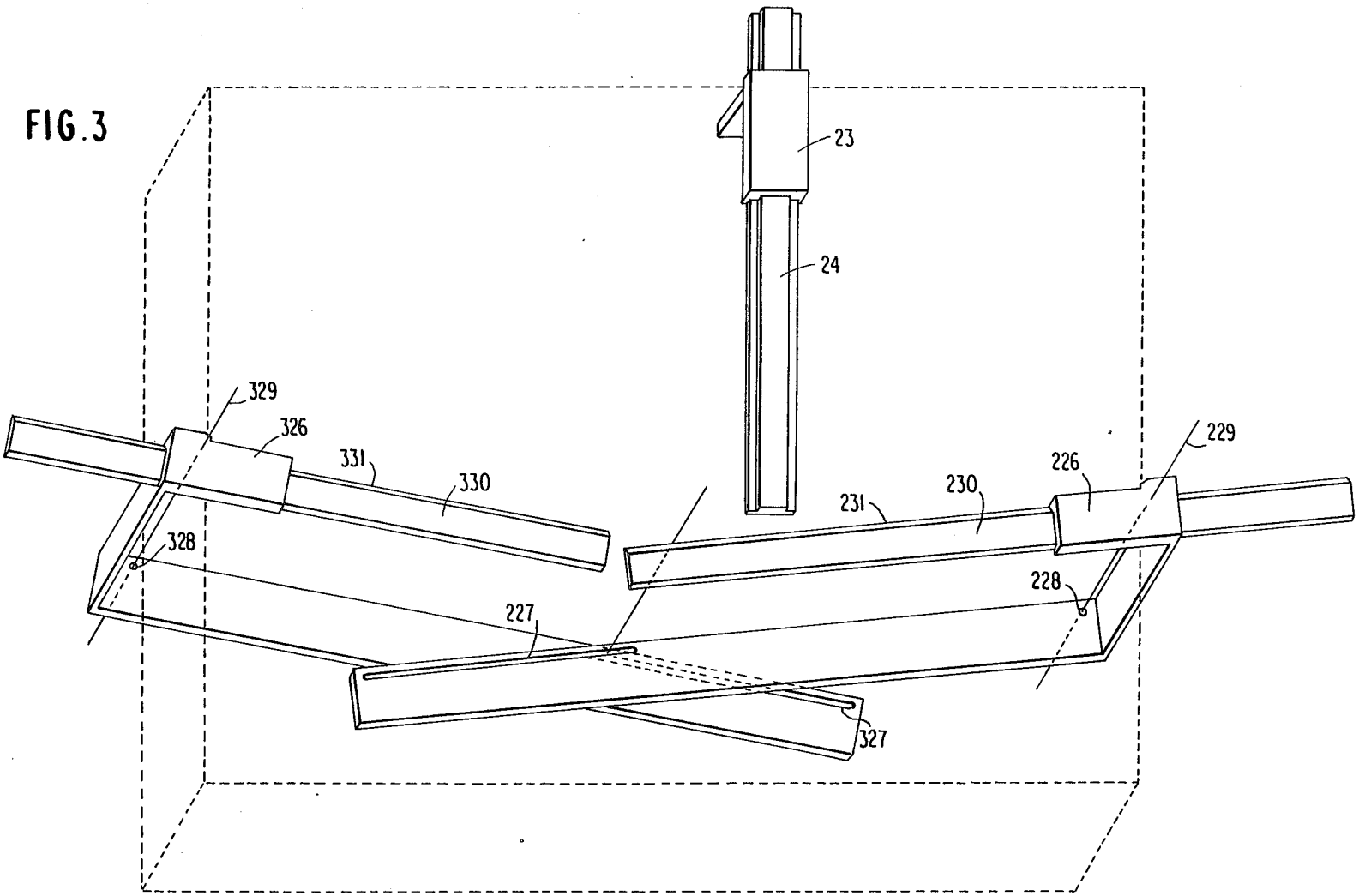
FIG. 3 is an isometric view of the three straight edge devices in their approximate positions.

The data listed in the first line of the table is pertinent to the example depicted in FIGS. 1, 2B, and 3. GML in line 1 when read from right to left as it appears in FIG. 2A will cause the left positioner to move at a rate of only 40% that of the center positioner. Likewise, GMR when read from left to right will result in the right positioner moving at a rate of only 80% that of the center positioner. The bottom of Central Positioner 125 has a cylindrical Stud engages the Slots 227 and 327 of the Right and Left Edge Carriers 226 and 326 in FIG. 3. Likewise, the Right Left Positioners 225 have Pivot Pins 225A which are held in by retaining screws (not shown). The Pivot Pins 225A pass Holes 228 and 328 and into cylindrical recesses (not located in line with the Pivot Axes 229 and 329 of the two Edge Carriers 226 and 326.

The Right and Left Straight Edges and 330 are mounted in slidable fashion in their respective so as not to interfere with one another or the Verti Straight Edge 24.

In summary, as the Horizontal Drive Gear 110 is rotated, the side Positioners 225 will move at rates than the Center Positioners 125 and in such a manner that the Upper Edges 231 and 331 of the two Horizontal Straight and 330 will always point at respective preselected right left vanishing points while also pointing to a common point intersection with the Line of Vision.

Figure 4B:
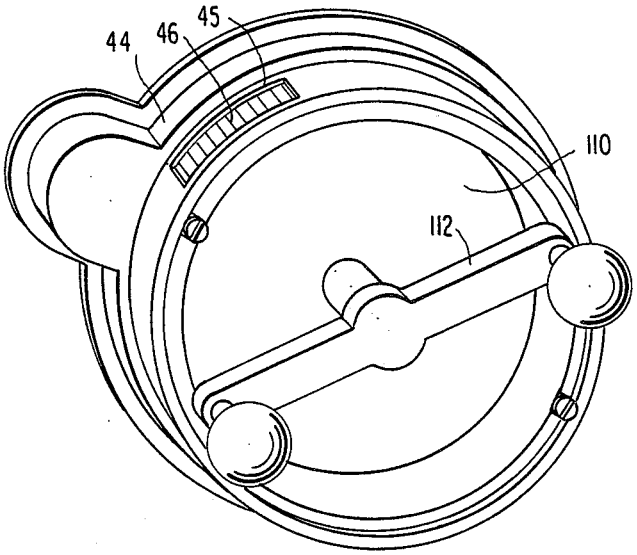
FIGS. 4A and 4B are parallel perspective views of a calibrated scale attached to a drive gear and its cover.
Figure 4A:
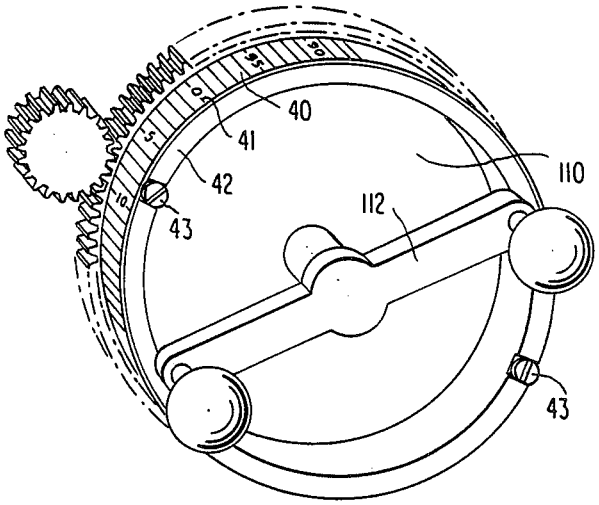

FIGS. 4A and 4B show a means attaching calibrated scales to the drive gears of the drafting table.

Since the Vertical Positioner 22 and the Center Horizontal Positioner 125 both move at a rate of one inch for each rotation of their respective Drive Gears 10 and 110, a circular tape could serve as a Scale 40. When divided into 100 parts by gradation marks 41, it would indicate movements of the straight edges in increments of one hundredth of an inch.

If desired, additional gradations and/or a vernier would provide more precision in positioning the straight edges.

The Scale 40 would be mounted on a Circular Flange 42 attached to the Drive Gear 10 or 110 and would be held in place by screws 43 in such a manner that it could be easily rotated for calibration purposes, clamped in place, or replaced with a different scale.

Since most Engineering Scales are such that one inch equals 10 feet, 20 feet, 30 feet, etc., the Scale 40 could be furnished with gradation markings matching any desired scale for the production of scaled drawings without the use of a scaled ruler.

The Cover 44 for the drive gears would be provided with a Window 45 and Cross Hairs 46 to facilitate reading of the Scale 40.

If desired, motors (not shown) could be mounted to engage special gears (not shown) on both of the Shafts 11 and 111 for automatic positioning of the straight edge carriers. Likewise, foot pedals and/or pushbutton operators with digital read out could be provided.

A means for moving a vertical straight edge in such a manner that it would always point to the station or viewing point will now be described. Likewise, it would utilize two parallel screw shafts which rotate at different rates. However, anytime the object is rotated with respect to the picture plane (which is always the case except in parallel perspective), the screw shafts would have to have threads which are progressively closer together on either side of the center line of view. Since each angle of view and each viewing distance would require a different set of screw shafts, this capability is not feasible.

As an alternative to avoid the necessity of projection, the preferred embodiment of this invention will include a built-in special computer set up to solve the following equations:

$$Lp = VR \times \mathrm{Tan}\theta \times L \times \mathrm{Cos}\theta / (L \times \mathrm{Sin}\theta + VR \times \mathrm{Tan}\theta)$$

$$Wp = VR \times \mathrm{Tan}\theta \times W \times \mathrm{Sin}\theta / (W \times \mathrm{Cos}\theta + VR \times \mathrm{Tan}\theta)$$

where Lp is the length in perspective measured along the line AB' (FIG. 1), VR is the value of the Right Vanishing Point, $\theta$ is the Angle of View, L is the length measured along the line AB, Wp is the width in perspective measured along the line AD', and W is the width measured along the line AD.

Values for VR and $\theta$ would be entered into memory at the beginning of the table setup. Subsequent entries of either a L or W variable would immediately return the respective perspective value, and the vertical straight edge could then be positioned accordingly.

Parallel Perspective

In the case of Parallel Perspective Drawing, the object is aligned parallel to the Picture Plane. This type of perspective is ideal for drawing objects having circles or other curves located in a vertical plane, or for drawing interiors, street vistas and similar scenes where considerable depth is to be represented. Except for architectural interiors, the Station Point is usually located above the object and either to the right or left, yet not so far as to cause unpleasant distortion.

The nature of parallel perspective requires true vertically and horizontally moving straight edges as well as a third straight edge which always points to the Viewing Point. Consequently., my Drafting Table is also ideal for making parallel perspective drawings.

Figure 5:
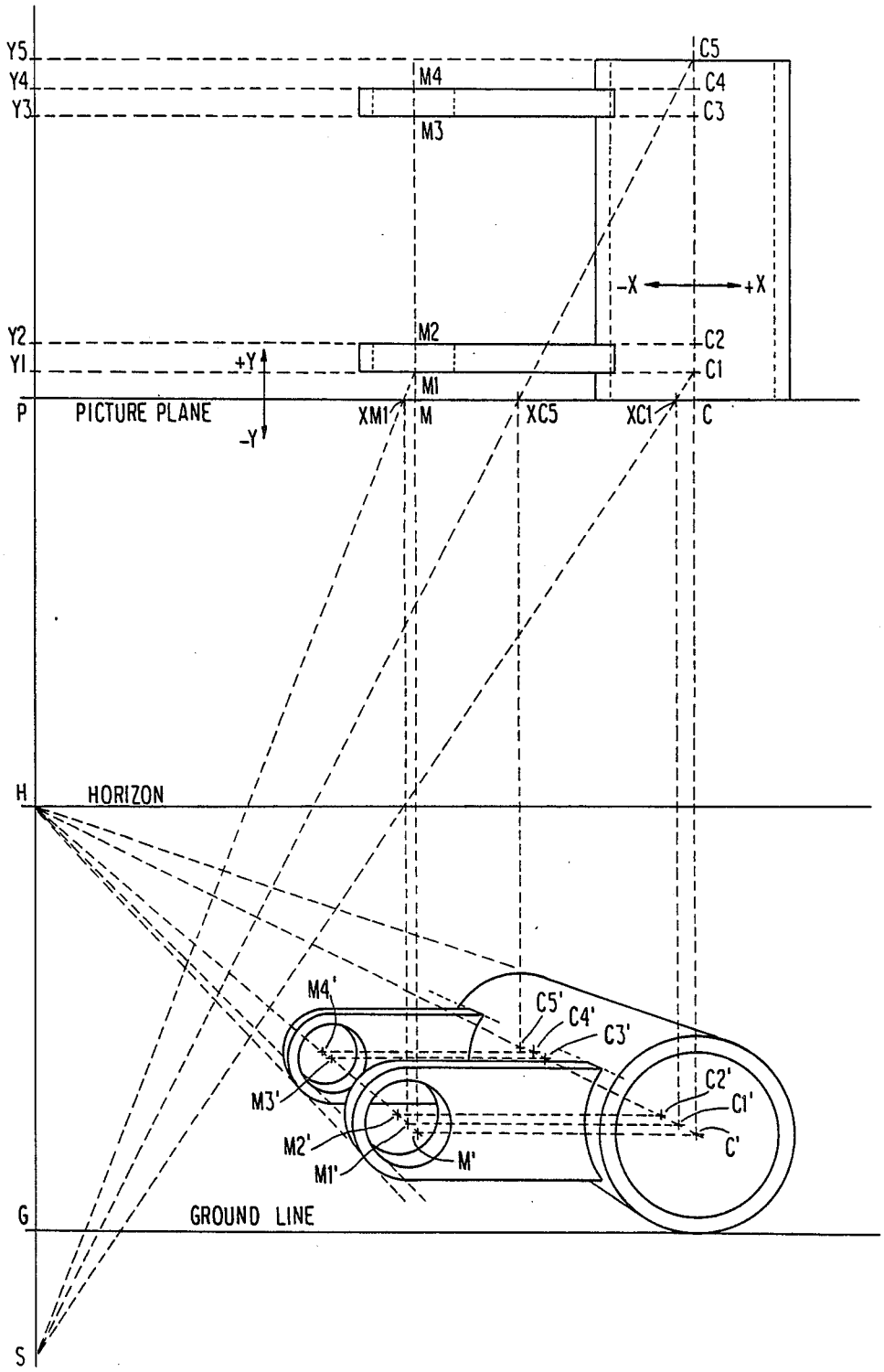
FIG. 5 is a sketch of a parallel perspective layout.

In a typical parallel perspective set-up as depicted in FIG. 5, one would first turn the Horizontal Drive Gear 110 until both horizontal straight edges are in their true horizontal positions, using the reversing switch, if necessary. After then ensuring that both plug-in modules have one to one ratios, both straight edges would be simultaneously moved up to the desired level of the Horizon. Disengaging the Left Reversing Gear 219 will result in Left Pivot Pin 226 remaining at that point which, in this example, is the Viewing Point.

Subsequent rotations of Gear 110 will move the left and right straight edges in such a manner that their upper edges will always intersect at the vertical center line of the Table, even though the right straight edge is moving in true horizontal fashion while the left straight edge is always pointing to the Viewing Point.

Horizontal calibration would be performed when the right straight edge is at the Ground Line and vertical calibration performed at the Center Line of the Table. Dimensions in the Picture Plane would represent actual values. Perspective dimensions would either have to be projected as in FIG. 5 or, as in the case of my Table, computed on a built-in calculator, preprogrammed to solve an equation derived from the Law of Inscribed Triangles as applied to FIG. 5 as follows:

$$(PC+X)/(SP+Y)=(PC+X')/SP$$

$$PC+X'=(SP\times(PC+X))/(SP+Y)$$

$$X=(SP\times(PC-X))/(SP+Y)-PC$$

where SP and PC are predetermined by the Table set-up, X and Y are dimensions taken from the top view of the object, and X' represents the resultant X-axis dimensions as projected on the Picture Plane.

In the example of FIG. 5, SP=34 inches, PC=24 inches, and the object to be drawn is a cylindrical pipe 12 inches long with an outside diameter of 7 inches, an inside diameter of 6 inches and with two 4-inch by 1-inch rectangular flanges, each with 3 inch diameter holes, the centers of which are located ten inches away from the center of the pipe. The outside faces of the two flanges are located 1 inch in from the ends of the pipe. The Horizon is 15 inches above the Ground Line.

With the values of SP and PC entered into memory, subsequent entries of pertinent values of X and Y would produce the perspective X' values of points on the object necessary to produce the perspective drawing as depicted in FIG. 5. One sequence in producing this drawing using my Table is as follows:

First, the center line of the pipe could be located by turning the Horizontal Drive Gear 110 until its scale reads 3.5 inches, i.e., half the outside diameter of the pipe. Now, a horizontal line drawn across the center of the Table using the extended right straight edge will intersect with a "vanishing" line drawn using the extended left straight edge at C'. The vanishing line represents the center line of the pipe and C' represents the center of the front face of the pipe.

The inside and outside circles at the front face can be drawn with a compass and, if desired, the dimensions of these circles can be established with the vertical straight edge set at the scale values of 3.5 and then 3 inches.

The outside edges of the pipe can be drawn by adjusting the left straight edge until it is tangent to each side of the outside circle.

The center of the circle representing the rear face of the pipe can be computed by entering the X and Y coordinates (0,12), yielding an X' value of −6.261 inches. By setting the vertical scale to this value, a line can be drawn across the center line HC' at C5', thus establishing the center. The visible arc can be drawn by adjusting the compass so that a circle, if drawn, would be tangent to the vanishing lines which represent the outside edges of the pipe.

Similarly, the two arcs representing the intersection of the front faces of the two flanges with the pipe can be drawn after computing the X' values of C1' and C3'.

The center line HM' of the two flange holes can be drawn with the left straight edge after establishing M' with the vertical straight edge set to X=−10 inches and the right straight edge set to 3.5 inches. Since M represents a point in the Picture Plane, the radii of the circles and arcs representing the holes and circular ends of the flanges can be established with the vertical straight edge and scale. Circular arcs represented by dotted lines in FIG. 5 can be drawn with a compass and the left straight edge can be used to draw tangent vanishing lines E and F.

Circular center points M1', M2', M3', and M4' can be projected to vanishing line HM' either from vanishing line HC' using the right straight edge or with the vertical straight edge after computing their respective X' values. The visible circles and arcs can then be drawn with a compass from said center points by adjusting the compass for tangency to the appropriate vanishing line E or F.

The top and bottom edges of the two flanges can now be drawn by positioning the right straight edge for tangency to the appropriate arc.

The above brief description of a drawing application thus demonstrates how my Prospective Drawing Table can be used to produce a moderately difficult parallel perspective drawing where the only accessories necessary are a pen and compass.

It will be appreciated that various changes and modifications could be made to the preferred embodiment discussed above without departing from the spirit and scope of the invention as defined in the appended claims. For example, the table could be provided with a mechanism for automatically positioning the straight edges, utilizing well established means such as pulleys and cables in place of the screw shafts and using a digital input to a servo to turn the drive shaft.

What is claimed is:

1. A drafting table of the type for use in the preparation of drawings by the use of at least a vertical straight edge and first and second horizontal straight edges, said table including top and bottom horizontal edges and left and right side vertical edges, and further comprising:

vertical straight edge support means (23) for determining the horizontal position of said vertical straight edge;

first horizontal straight edge support means (226) for determining the vertical position of said first horizontal straight edge;

second horizontal straight edge support means (326) for determining the vertical position of said second horizontal straight edge; and horizontal straight edge control means operable in at least a first mode for moving said first and second horizontal straight edge support means such that, upon vertical movement of either of said first or second horizontal straight edges, said first horizontal straight edge is automatically controlled to always point to a first predetermined point mechanically decoupled from said first horizontal straight edge and said second horizontal straight edge is automatically controlled to always point to a second predetermined point mechanically decoupled from said second horizontal straight edge.

2. A drafting table as defined in claim 1, wherein said first and second predetermined points are beyond said left and right side vertical edges.

3. A drafting table as defined in claim 1, wherein said first and second predetermined points are beyond said top and bottom horizontal edges.

4. A drafting table as defined in claim 1, wherein said horizontal straight edge control means comprises:

a first positioning means (125) for coupling to each of said first and second horizontal straight edge support means;

first position control means for controlling the vertical position of said first positioning means;

at least one second positioning means (225) for coupling to said first horizontal straight edge control means at at least one point spaced apart from said first positioning means; and second position control means for controlling the vertical position of said second positioning means.

5. A drafting table as defined in claim 4 wherein said first positioning means includes a pin (126) extending therefrom, and each of said straight edge support means includes a slot (227, 327) therein for slidingly accepting said pin.

6. A drafting table as defined in claim 4, wherein said at least one second positioning means comprises two second positioning means (225) each for coupling to a respective one of said first and second horizontal straight edge support means at a point spaced apart from said first positioning means.

7. A drafting table as defined in claim 6, wherein said horizontal straight edge control means comprises means for vertically moving said two second positioning means at different rates.

8. A drafting table as defined in claim 6, wherein said first position control means comprises a center shaft (124) and said second position control means comprises a first side shaft (224) for driving one of said two second positioning means and a second side shaft (224) for driving the other of said two second positioning means, said table including rotating means for rotating said center and side shafts at predetermined relative rates of rotation, said rotating means comprising a user-operable member (112), center coupling means (118-123) for coupling the user-operable member to said center shaft (124), first side coupling means (218-223) for coupling said user-operable member to said first side shaft (224), second side coupling means (218–223) for coupling said user-operable member to said second side shaft (224), and wherein said rotating means includes means for reversing or disabling the drive to one of said side shafts without reversing or disabling the drive to the other of said side shafts.

9. A drafting table as defined in claim 8, wherein said table has a horizontal reference line, and wherein the distance from said horizontal reference line to said first horizontal straight edge along said right side vertical edge of said table bears a first predetermined ratio to the distance between said horizontal reference line of said table and said first horizontal straight edge at the location of said first positioning means, and the distance from said horizontal reference line to said second horizontal straight edge along said left side vertical edge of said table bears a second predetermined ratio to the distance between said horizontal reference line of said table and said first horizontal straight edge at the location of said first positioning means, and said first and second predetermined ratios determine said relative rates of rotation.

10. A drafting table as defined in claim 4, wherein said first position control means comprises a first shaft (124) and said second position control means comprises at least one second shaft (224), said table including rotating means for rotating said first and second shafts at predetermined relative rates of rotation.

11. A drafting table as defined in claim 10, further comprising adjustment means for adjusting the ratio of said relative rates of rotation.

12. A drafting table as defined in claim 11, wherein said rotating means comprises a user-operable member (112), first coupling means (118–123) for coupling the user-operable member to said first shaft (124), second coupling means (218-223) for coupling said user-operable member to said at least one second shaft (224), and wherein said adjustment means comprises a replaceable portion (221–223) of at least one of said first and second coupling means for selecting the movement ratio between said first and second shafts.

13. A drafting table as defined in claim 10, wherein said rotating means comprises a crank means (112) having an outer periphery, rotation of said crank means by a predetermined amount resulting in movement of said first positioning means, said crank means further including a calibration scale on said outer periphery corresponding to the scale of a drawing prepared on said drafting table.

14. A drafting table as defined in claim 13, wherein said calibration scale is replaceable in accordance with different drawing scales.

15. A drafting table as defined in claim 10, wherein said table has a horizontal reference line, and wherein the distance from said horizontal reference line to said first horizontal straight edge along said right side vertical edge of said table bears a first predetermined ratio to the distance between said horizontal reference line of said table and said first horizontal straight edge at the location of said first positioning means, and the distance from said horizontal reference line to said second horizontal straight edge along said left side vertical edge of said table bears a second predetermined ratio to the distance between said horizontal reference line of said table and said first horizontal straight edge at the location of said first positioning means and wherein said first and second predetermined ratios determine said relative rates of rotation.

16. A drafting table as defined in claim 1, further comprising means for adjusting said horizontal straight edge control means to permit said horizontal straight edges to be moved vertically while remaining at a fixed horizontal angle.

17. A drafting table as defined in claim 1, wherein said horizontal straight edge control means is operable in a second mode for moving said first straight edge such that it always points to said first predetermined point while all points on said second straight edge are moved vertically at the same rate.

18. A drafting table as defined in claim 1, further comprising vertical straight edge control means for horizontally moving said vertical straight edge support means such that said vertical straight edge always point to a third predetermined point.

19. A drafting table as defined in claim 1, further comprising means for adjusting said horizontal straight edge control means to move said first and second horizontal straight edges vertically such that their straight edge always intersect at a predetermined horizontal position on said table.

20. A drafting table of the type for use in the preparation of drawings by the use of at least a vertical straight edge and first and second horizontal straight edges, said table including top and bottom horizontal edges and left and right side vertical edges, and further comprising:

vertical straight edge support means (23) for determining the horizontal position of said vertical straight edge; and horizontal straight edge position control means operable in at least a first mode for moving said first and second horizontal straight edges such that upon vertical movement of either of said first or second horizontal straight edges, said first horizontal straight edge is automatically controlled to always point to a first predetermined point and said second horizontal straight edge is automatically controlled to always point to a second predetermined point, said horizontal straight edge position control means comprising first means for pivotably supporting said first horizontal straight edge at two first pivot points, second means for pivotably supporting said second horizontal straight edge at two second pivot points, and gear driven means for simultaneously controlling the relative positions of all of said pivot points.

21. A drafting table as defined in claim 20, wherein one of said two first pivot points is common with one of said two second pivot points.

22. A drafting table as defined in claim 20, wherein said horizontal straight edge position control means includes means for automatically controlling the vertical positions of all pivot points whenever the vertical position of any one pivot point is changed.

23. A drafting table of the type for use in the preparation of drawings by the use of at least a vertical straight edge and at least one horizontal straight edge, said table comprising:

vertical straight edge support means (23) for determining the horizontal position of said vertical straight edge;

horizontal straight edge support means (226) for determining the vertical position of said horizontal straight edge; and horizontal straight edge control means operable in at least a first mode for moving said horizontal straight edge support means such that, upon vertical movement of said horizontal straight edge, said horizontal straight edge is automatically controlled to always point to a predetermined point mechanically decoupled from said horizontal straight edge.

* * * * *